United States Patent [19]

Reich et al.

[11] 4,168,603

[45] Sep. 25, 1979

[54] PROCESS OF MANUFACTURING PLASTIC STRINGS FOR BALL-STRIKING IMPLEMENTS

[75] Inventors: Gerhard Reich, Innkreis; Walter Stephan, Braunau, both of Austria

[73] Assignee: Fischer Gesellschaft m.b.H., Ried im Innkreis, Austria

[21] Appl. No.: 876,948

[22] Filed: Feb. 10, 1978

[30] Foreign Application Priority Data

| | | | |
|---|---|---|---|
| Feb. 10, 1977 | [AT] | Austria | 905/77 |
| May 2, 1977 | [AT] | Austria | 3098/77 |
| May 2, 1977 | [AT] | Austria | 3100/77 |

[51] Int. Cl.[2] ..... D02G 3/06; D02G 3/44

[52] U.S. Cl. ..... 57/260; 57/31; 57/310

[58] Field of Search ..... 57/150, 151, 157 S, 57/165, 167, 31, 32, 36, 260, 310; 264/288

[56] References Cited

U.S. PATENT DOCUMENTS

| | | | |
|---|---|---|---|
| 2,403,317 | 7/1946 | Warren | 57/260 |
| 3,126,699 | 3/1964 | Lefevre et al. | 57/151 X |
| 3,322,613 | 5/1967 | Rasmussen | 264/288 X |
| 3,350,491 | 10/1967 | Rasmussen | 264/288 X |
| 3,354,630 | 11/1967 | Segal | 57/165 X |
| 3,496,716 | 2/1970 | Howard et al. | 57/260 |
| 3,500,626 | 3/1970 | Sandiford | 57/260 |
| 4,034,055 | 7/1977 | Strutzel et al. | 264/288 X |
| 4,082,598 | 4/1978 | Katagi | 264/288 X |

FOREIGN PATENT DOCUMENTS

| | | |
|---|---|---|
| 1150913 | 1/1964 | Fed. Rep. of Germany . |
| 30616 | 8/1965 | Fed. Rep. of Germany . |
| 1510636 | 4/1970 | Fed. Rep. of Germany . |
| 440895 | 1/1936 | United Kingdom . |
| 581496 | 10/1946 | United Kingdom . |
| 775093 | 5/1957 | United Kingdom . |
| 811297 | 4/1959 | United Kingdom . |
| 1101384 | 1/1968 | United Kingdom . |

*Primary Examiner*—Donald Watkins
*Attorney, Agent, or Firm*—Fleit & Jacobson

[57] ABSTRACT

At least one plastic sheeting element which is oriented at least monoaxially and at least in part in a direction which differs appreciably from the longitudinal direction of the sheeting element is twisted to form a string for a ball-striking implement.

17 Claims, 3 Drawing Figures

PROCESS OF MANUFACTURING PLASTIC STRINGS FOR BALL-STRIKING IMPLEMENTS

SUMMARY OF THE INVENTION

The invention provides a process of manufacturing improved plastic strings for ball-striking implements. Plastic sheeting elements are provided, which are highly oriented at least monoaxially and at least in part in a direction which differs appreciably from the longitudinal direction of the sheeting element. To make a string, one of these sheeting elements is twisted in itself or a plurality of such sheeting elements are twisted together. The sheeting element or elements may be provided with a coating of adhesive before or during the twisting operation. The twisted product may be coated with a flexible protective varnish.

This invention relates to a process of manufacturing plastic strings for ball-striking implements, particularly tennis rackets.

It has been known for a very long time to make strings from catgut. That technology has been used for a long time only to make strings for musical instruments.

At the advent of the first ball games played with striking implements and during the subsequent development of tennis in its present-day form, catgut strings have been available from the beginning. This had a direct influence on the form of the ball and striking implement and an indirect influence on the nature and form of the court and the rules of the game. For that reason, presumably, catgut strings have remained prominent among the strings used in ball-striking implements although catgut strings have some disadvantages, which will be explained hereinafter.

Catgut strings are made from the intestines of sheep and more recently also from intestines of bovine animals. These intestines are first cut into strips, which are then subjected to various chemical treatments. Several treated strips are twisted together. The twisted products must be dried in air-conditioned rooms. The resulting raw strings are ground to be round and smooth and are finally impregnated with a special oil or with varnish.

Catgut strings forming the striking surface of ball-striking implements have the following disadvantages: They are highly hygroscopic so that a high humidity of the air or a moist court results in a great decrease of tension and a great increase of the wear of the strings. Because catgut strings are expensive owing to their complicated manufacture, they require careful attention owing to their sensitivity.

These disadvantages have favored the development of strings of synthetic materials, mainly polyamides, for use as the striking surface of ball-striking implements. At the present stage of technology, these synthetic strings meet virtually all requirements as regards wear resistance and constancy of tension in all climates and can be made much more economically than catgut strings.

On the other hand, all conventional synthetic strings for forming a striking surface have the serious disadvantage that they differ from catgut strings in elastic behavior so that the implements provided with synthetic strings exhibit a distinctly poorer playing performance. For instance, a player using an implement provided with synthetic strings for a powerful blow gets a "hard" reaction, which may promote irritations in the player's arm, particularly at the elbow and the tendons of the lower arm.

There are numerous different types of synthetic strings for ball-striking implements. Plain monofilaments provide for less comfortable playing than, e.g., strings made by twisting a plurality of monofilaments or split fibers together. But even the best synthetic strings are greatly inferior to catgut strings when used in striking implements.

It is an object of the invention to enable the manufacture of synthetic strings which are intended for use in ball-striking implements and combine the low cost, high wear resistance and low sensitivity to moisture of conventional plastic strings with a playing performance which is highly similar to that of catgut strings.

This object is accomplished by a process in which the strings are made in that plastic sheeting elements are twisted together which are highly oriented at least monoaxially and at least in part at an angle which appreciably differs from 0°. The sheeting elements are preferably oriented at an angle of 45°. Such sheeting elements can simply be made from webs of plastic sheeting which is highly oriented monoaxially in its longitudinal direction and from which tapes are subsequently cut at the stated angle. The plastic tapes which are processed have a width between 2 mm and 15 mm.

It has been found that a particularly high quality can be obtained in accordance with the invention if a plurality of sheeting elements which are oriented in the same direction or in different directions are twisted together.

The number of tapes which are to be twisted together to form one string, which is about 1.2 to 1.4 mm or 1.6 mm in diameter, depends on the width and thickness of the tapes and on the number of turns to which the tapes are twisted together per unit of length. Part of the tapes to be twisted together to make one string may be turned about the longitudinal axis of each tape so that these tapes are turned upside down and in these tapes the direction of the longitudinal orientation of the plastic molecules (corresponding to the direction of orientation of the original sheeting) is at such an angle to the direction of the longitudinal orientation of the remaining tapes that the longitudinal axis constitutes an axis of symmetry. When the tapes cut from the sheeting web extend at an angle of 45° to the direction of orientation, the directions of molecular orientation of the tapes of the two parts will then include an angle of 90°.

In accordance with a further feature of the invention the sheeting elements to be twisted together may be biaxially oriented. For this purpose, tapes cut at any desired angle from the sheeting web or blown tubing, may be used and a string may be made in that only one sheeting element is twisted in itself.

Biaxially oriented sheeting elements are plastic sheeting elements which have been stretched parallel and at right angles to the longitudinal direction of the original extrusion to a multiple of the respective original dimension. Biaxially oriented blown plastic tubing is plastic tubing which has been blown in a still warm state and has thus been attenuated to the wall thickness of sheeting.

Strings made from biaxially oriented sheeting or tubing are very similar in elastic behavior and playing performance to catgut strings and superior in playing performance to all synthetic strings made from monoaxially oriented elements.

The blown tubing to be twisted has preferably a diameter of about 20 mm and a wall thickness of about 0.01 mm. The stretch ratio transversely to the longitudinal direction of the original extrusion should be comparable to the stretch ratio in said longitudinal direction. The longitudinal-to-transverse stretch ratio should be about 0.3 to 3.0. In view of the wide range of suitable materials (e.g., polyamide or polyvinyliden chloride), this is not intended as a restriction.

Where a plurality of tapes are twisted together, some of these tapes may be simply cut from a sheeting web which is only monoaxially oriented. When a certain longitudinal-to-transverse stretch ratio has been selected, numerous types of strings having properties which differ in a certain range may be made in that the angles between the direction in which the tapes are cut from the sheeting web, on the one hand, and the two directions of orientation, are varied.

In accordance with a further feature of the invention, the strings are coated with a suitable composition, such as varnish, for protection against abrasion, moisture and ultraviolet radiation, as is known for catgut strings.

It has now been found that the time at which the coating is applied is important for the quality and performance of the strings.

Surprisingly it has been found that the fixation of the twist can be improved and the wear resistance can be increased if, in accordance with the invention, the coating is applied before or during the twisting operation.

An adhesive which has been applied results also in a coupling of possibly different directions of highest mechanical strength of the sheeting strips. This results in a string which has excellent strength properties and an excellent playing performance.

The resulting strings are highly similar in elastic behavior to catgut strings and for this reason are superior in playing performance to all plastic strings which have been made in the conventional manner from plastic tapes or filaments which are oriented only in their longitudinal direction.

The string which has thus been made should be coated for protection against abrasion, moisture and ultraviolet radiation, as is conventional with catgut strings.

For this purpose, some more adhesive may be applied before the twisting operation so that the surplus adhesive forms a uniform coating on the twisted string, provided that the adhesive can form a protective coating, alternatively, a twisted string which is free from surplus adhesive may be coated with protective varnish.

An embodiment of the process will now be explained with reference to the accompanying drawing, in which FIG. 1 shows a portion of a sheeting web from which tapes can be cut which have any desired length and a finite width and extend in a major part of their length at an oblique angle to the longitudinal direction of the sheeting web.

Figure 1:
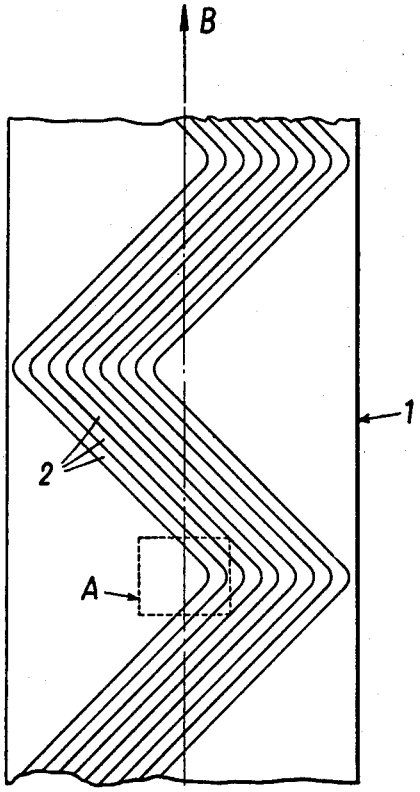

FIG. 1 shows a web 1 of plastic sheeting. From that strip 1, tapes 2 are cut in accordance with the pattern shown on the drawing. The arrow B indicates the direction in which web 1 is to be stretched. Before the plastic web is cut apart, it is stretched in that direction to a multiple of its length.

The web may be stretched in a second direction which is at right angles or at an oblique angle to direction B. Alternatively, the direction B in which the web is stretched may be oblique to rather than in the longitudinal direction.

Figure 2:
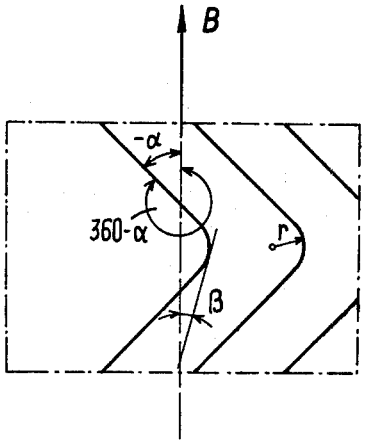
FIG. 2 is an enlarged view showing the portion A of FIG. 1.

In carrying out the process according to the invention a group of zig-zag tapes 2 are cut from the web 1 in one direction, in the present embodiment in the longitudinal direction B in which the web 1 has been stretched. It is apparent from FIG. 2 that the straight portions of the tapes include the angles $180°-\alpha$, $180°+\alpha$ and $360°-\alpha$ (where $\alpha$ is preferably 45°) with the longitudinal direction or the direction of orientation of the web. The change in direction by an angle having an absolute value of $180°-2\alpha$ must not be abrupt, at a corner, because the resulting notch would decrease the strength, but must be effected by a bend having a radius which depends on the width of the tape.

Whereas the teaching that the cut is to be made at a specified angle to the direction of orientation, preferably to the direction of longitudinal orientation, is abandoned near the bends, the length ratio between the straight and curved portions of the tapes may be very large, especially if the tapes have a small width of only a few millimeters, so that the curved portions ($0 \leqq \beta \leqq \alpha$) are negligible in length compared to the overall length of the tapes, particularly because the undesired condition $\beta=0$ is present only at the apex of each curve.

Figure 3:
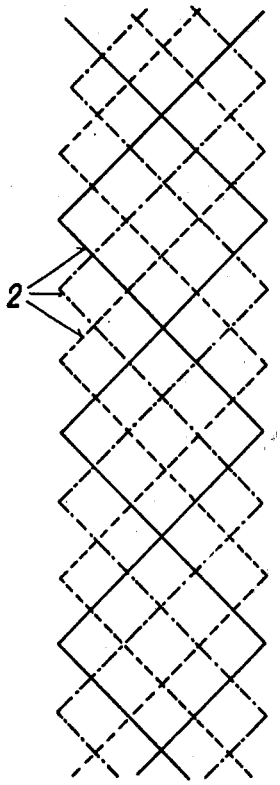
FIG. 3 is a diagrammatic view showing three pairs of tapes, which are indicated by different types of lines, before the tapes are twisted together, the tapes being shown in an unoriented state for the sake of clarity.

Two or three tapes having the same orientation or different orientations are usually twisted together. Three tapes 2 are shown by way of example in FIG. 3. Where two tapes are used, the tapes are suitably offset in their longitudinal direction by one-half of the repeat length of the zig-zag pattern so that each tape receives in the gap between two left- or right-hand bends a left- or right-hand bend of the other tape.

The tapes which have thus been made and arranged are twisted together to form a string in the manner described hereinbefore and in conjunction with an application of adhesive. A protective varnish may be applied to the resulting string, if required.

It will be understood that various modifications in structure may be adopted within the scope of the invention. For instance, the tapes may be cut in such a pattern that they extend partly in the direction of orientation and partly at the claimed angle to that direction. Besides, zig-zag tapes may be similarly cut from sheeting webs which are biaxially oriented.

Any desired number of plastic tapes which are all oriented in the same direction or are oriented in different directions may be twisted together within the scope of the invention. For instance, all tapes may be biaxially oriented at the same angles. Individual tapes may be oriented in different directions. It is also possible to use a plurality of tapes, some or one of which is monoaxially oriented whereas at least one additional tape is biaxially oriented. In that case the directions of orientation may be selected as desired. For instance, the tapes may be oriented in a longitudinal first direction and in a second direction which is at right angles or at an oblique angle to the first direction. Both directions of orientation may be at any desired angles to the longitudinal direction of the tapes.

The stretch ratio may be selected as desired in all cases. The use of highly oriented tapes will depend on the nature of the materials which are employed. The strings may be made from various different materials, such as polyamide, polyester, polypropylene etc. The upper limit at which the sheeting splits in the longitudinal direction and the tapes can no longer be cut obliquely from the web will depend on the material of the sheeting and may also depend on the method by which it is stretched. (A longitudinal splitting of the sheeting need not be feared if the sheeting is stretched biaxially or if laminated sheeting webs having plies oriented in different directions are employed). The use of stretch ratios which are too small, i.e., substantially below the limit at which longitudinal splitting occurs, results in a strength which is lower than that which can be attained, i.e., the strings have a lower modulus of elasticity and creep strength. During the stretching of polypropylene, e.g., longitudinal splitting takes place at stretch ratios of about 10:1 to 12:1 so that suitable stretch ratios are about 8:1 to 9:1.

Strings made from polyamide sheeting may be provided with adhesives or protective varnishes consisting of polyurethane or with flexible polyamidoepoxy varnishes. Strings of polyester sheeting may be pretreated with a primer (Haftvermitter TN of Bayer) and subsequently be coated with polyurethane adhesive or varnish.

Very good strings may be made, e.g., from biaxially oriented polyester sheeting (Hostaphan RGHH of Kalle) in such a manner that the main part of the tapes extend at an angle of 30° to the predominant direction of longitudinal orientation. The sheeting has a modulus of elasticity of about 700,000 N/cm$^2$ in that direction, and the remaining part of the tapes extend at an angle of 60° to that direction. The tapes are twisted together in such a sense that the direction of highest strength of the main part of the tapes lies generally in the longitudinal direction of the resulting string.

The adhesive or other coating composition may consist of a flexible polyurethane resin.

Hostaphan RNHH of Kalle may also be used. In that case, all tapes are cut from the sheeting web in the direction of the bisector (=45°) between the two equivalent directions of orientation (modulus of elasticity in each direction about 450,000 N/cm$^2$).

What is claimed is:

1. A process of manufacturing plastic strings from a single sheeting element which comprises twisting a plastic sheeting element which is highly oriented at least monoaxially and at least in part in a direction which differs appreciably from the longitudinal direction of the sheeting element about its longitudinal axis.

2. A process set forth in claim 1, characterized in that the orientation is at an angle of 45° to the longitudinal direction of the sheeting element.

3. A process as set forth in claim 1, characterized in that the oriented sheeting element comprises blown tubing that is twisted.

4. A process as set forth in claim 1, characterized in that the sheeting element is a tape cut in zig-zag shape from plastic sheeting and the longitudinal direction of the tape preferably agrees with the direction of orientation of the plastic sheeting.

5. A process of manufacturing a plastic string which comprises:

laying a plurality of sheeting elements one over the other, at least one of the sheeting elements being highly oriented at least in part in a direction which differs appreciably from the longitudinal direction of the sheeting element; and twisting the plurality of plastic sheeting elements together to form the string.

6. A process as set forth in claim 5, characterized in that the oriented sheeting elements comprise tapes that are twisted together.

7. A process as set forth in claim 5, characterized in that a string is made from a plurality of tapes of sheeting and part of said tapes are turned about their longitudinal axis so that the original directions of orientation of the plastic sheeting cross in the tapes of sheeting used in one string.

8. A process as set forth in claim 5, characterized in that the sheeting elements are coated with an adhesive before the sheeting elements are twisted together and said adhesive is applied in excess of the quantity required to bond the tubular or other sheeting elements together so that the adhesive forms a coating on the twisted string.

9. A process as set forth in claim 5, characterized in that at least one tape is biaxially oriented.

10. A process as set forth in claim 5, characterized in that at least one tape is monoaxially oriented.

11. A process as set forth in claim 5, characterized in that at least one oriented sheeting element comprises blown tubing twisted with said plurality of sheeting elements.

12. A process as set forth in claim 5, characterized in that the sheeting elements are tapes cut in zig-zag shape from plastic sheeting and the longitudinal direction of each tape preferably agreeing with the direction of orientation of the plastic sheeting.

13. A process as set forth in claim 12, characterized in that the tapes of sheeting cut in zig-zag shape have first longitudinally-extending portions positioned on one side of the longitudinal axes of the tapes, second longitudinally-extending portions positioned on the other side of the longitudinal axes of the tapes, and intermediate portions having bends interconnecting the first and second portions, the tapes of sheeting being arranged so that the bends are offset and the tapes required to make one string are longitudinally offset in such a manner that the bends of the tapes are distributed as uniformly as possible.

14. A process as set forth in claim 1, characterized in that the oriented sheeting element comprises a biaxially oriented tape that is twisted.

15. A process as set forth in claim 5, characterized in that all of said oriented sheeting elements comprise blown tubing.

16. A plastic string for forming a striking surface of a ball-striking implement which comprises a plastic sheeting element which is highly oriented monoaxially and in a direction which differs appreciably from the longitudinal direction of the sheeting element, the sheeting element being twisted about its longitudinal axis to form the string.

17. A plastic string for forming a striking surface of a ball-striking implement which comprises a plurality of plastic sheeting elements, at least one of which is highly oriented monoaxially and another one of which is oriented in a direction which differs appreciably from the longitudinal direction of the sheeting element, the sheeting elements being twisted together about their longitudinal axes to form the string.

* * * * *